US009405244B1

(12) United States Patent
Kitagawa

(10) Patent No.: US 9,405,244 B1
(45) Date of Patent: Aug. 2, 2016

(54) IMAGE FORMING APPARATUS WITH REDUCED LOAD FLUCTUATION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masaharu Kitagawa, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/806,781

(22) Filed: Jul. 23, 2015

(51) Int. Cl.
*G03G 15/20* (2006.01)

(52) U.S. Cl.
CPC ..... *G03G 15/2053* (2013.01)

(58) Field of Classification Search
CPC ..... G03G 15/2032; G03G 15/2053
USPC ..... 399/122, 328, 330
See application file for complete search history.

(56) References Cited

U.S. PATENT DOCUMENTS 7,643,785 B2 * 1/2010 Matsubara ..... G03G 15/206 399/329
8,326,197 B2 * 12/2012 Kim ..... G03G 15/2032 399/122
8,457,512 B2 * 6/2013 Seol ..... G03G 15/206 399/122
9,002,252 B2 * 4/2015 Uehara ..... G03G 15/2064 399/330

* cited by examiner

*Primary Examiner* — William J Royer
(74) *Attorney, Agent, or Firm* — Amin, Turocy & Watson LLP

(57) ABSTRACT

An image forming apparatus includes an image forming section configured to form an image on an image receiving medium; a fixing section configured to include a first roller, a second roller facing the first roller and a switching mechanism provided with a cam for switching positions of the first roller; and a control section configured to control a driving of the cam, and the cam includes a first position regulating section setting a contact position, a second position regulating section setting a separation position and a position changing section which is positioned between the first position regulating section and the second position regulating section in a driving direction of the cam and includes a fluctuation section for moving the first roller close to the second roller temporarily during a period of time the first roller is separating from the second roller.

10 Claims, 8 Drawing Sheets

IMAGE FORMING APPARATUS WITH REDUCED LOAD FLUCTUATION

FIELD

Embodiments described herein relate generally to an image forming apparatus.

BACKGROUND

Conventionally, there is an image forming apparatus such as a Multi-functional Peripheral (hereinafter referred to as an "MFP"), a printer and the like. The image forming apparatus comprises a fixing member, a press roller and a switching mechanism. For example, it is assumed that the fixing member is a cylindrical member such as a heat roller or a fixing belt. The switching mechanism switches a position of the press roller. The switching mechanism is provided with a cam for switching the position of the press roller. For example, at the time of passing an image receiving medium (hereinafter referred to as "sheet-passing time"), the switching mechanism makes the press roller contact with the fixing member. Hereinafter, a position where the press roller is contacted with the fixing member is referred to as a "contact position". On the other hand, at the time of not passing the image receiving medium (hereinafter referred to as a "non-sheet-passing time"), the switching mechanism separates the press roller from the fixing member. Hereinafter, a position where the press roller is separated from the fixing member is referred to as a "separation position". There is a possibility that a motion sound generates due to a load fluctuation at the time of switching from the contact position to the separation position (hereinafter referred to as a "switch time").

Especially, the pressing force of the press roller is set to be large in a color copier of which the sheet-passing speed is high (hereinafter referred to as a "high-speed color copier") to guarantee the fixing property. The press roller presses the fixing member to form a nip. To guarantee the fixing property, it is necessary to guarantee that the nip is wide. To guarantee that the nip is wide, it is considered to increase an amount of engagement of the press roller with the fixing member (hereinafter referred to as an "amount of engagement"). Further, reducing the heat capacity of the fixing member is effective to shorten a warming-up time and a first print time. It is required to separate the press roller from the fixing member absolutely at a non-sheet-passing time to reduce the heat capacity of the fixing member. However, if the amount of engagement is increased at the sheet-passing time, the movement distance of the press roller from the contact position to the separation position becomes long. At this time, to realize miniaturization and low cost, enough space for the switching mechanism can hardly be guaranteed in the high-speed color copier. Thus, the load fluctuation at the switch time tends to become large in the high-speed color copier, and therefore there is a possibility that the motion sound becomes louder.

DETAILED DESCRIPTION

Figure 1:
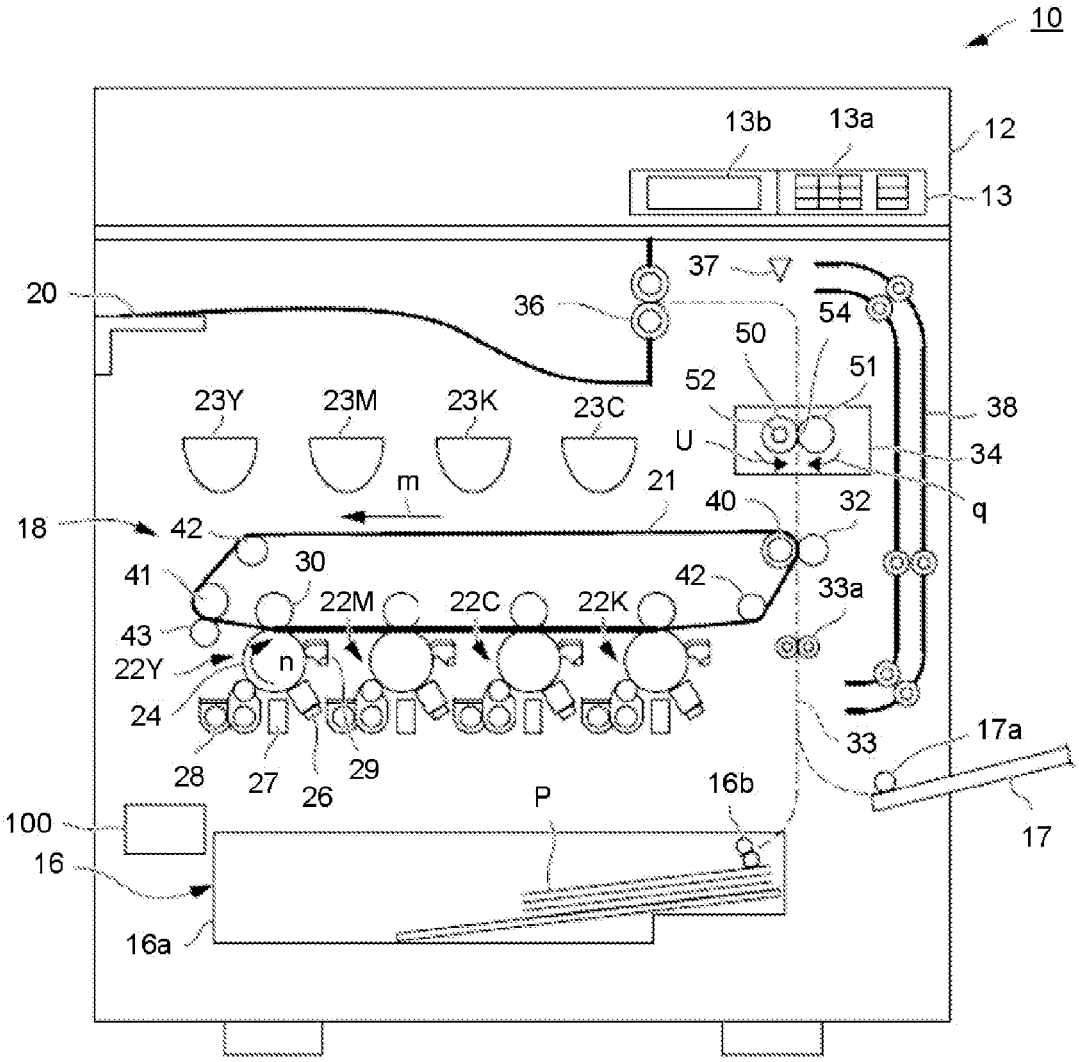
FIG. 1 is a side view illustrating an image forming apparatus according to an embodiment.

In accordance with an embodiment, an image forming apparatus comprises an image forming section, a fixing section and a control section. The image forming section forms an image on an image receiving medium. The fixing section includes a first roller, a second roller and a switching mechanism. The second roller faces the first roller. The switching mechanism is provided with a cam. The cam switches positions of the first roller. The control section controls a driving of the cam. The positions of the first roller switched by the switching mechanism include a contact position and a separation position. In the contact position, the first roller contacts with the second roller. In the separation position, the first roller separates from the second roller. The cam includes a first position regulating section, a second position regulating section and a position changing section. The first position regulating section sets a contact position. The second position regulating section sets a separation position. The position changing section is positioned between the first position regulating section and the second position regulating section in a driving direction of the cam. The position changing section includes a fluctuation section. The fluctuation section moves the first roller close to the second roller temporarily during a period of time the first roller is separating from the second roller.

Hereinafter, an image forming apparatus 10 of the present embodiment is described with reference to the accompanying drawings. Further, the same components are applied with the same reference numerals in each figure, and therefore the detailed description thereof is not provided.

FIG. 1 is a side view of the image forming apparatus 10 according to the embodiment. Hereinafter, an MFP 10 is exemplified as one example of the image forming apparatus 10.

As shown in FIG. 1, the MFP 10 comprises a scanner 12, a control panel 13, a sheet feed cassette section 16, a manual sheet feed tray 17, a printer section 18 and a sheet discharge section 20. The MFP 10 includes a CPU 100 which controls the whole MFP 10. The CPU 100 controls a main body control circuit 101 (refer to FIG. 11).

The scanner 12 reads an image from an original. The control panel 13 is provided with input keys 13*a* and a display section 13*b*. For example, the input keys 13*a* receive an input by a user. For example, the display section 13*b* is of a touch panel type. The display section 13*b* receives an input by the user and carries out a display to the user.

The sheet feed cassette section 16 includes a sheet feed cassette 16*a* and a pickup roller 16*b*. The sheet feed cassette 16*a* stores a sheet P serving as an image receiving medium. The pickup roller 16*b* picks up the sheet P from the sheet feed cassette 16*a*.

The sheet feed cassette 16*a* feeds an unused sheet P. The manual sheet feed tray 17 feeds the unused sheet P through a pickup roller 17*a*.

The printer section 18 forms the image read by the scanner 12 from the original. The printer section 18 includes an intermediate transfer belt 21. The printer section 18 supports the intermediate transfer belt 21 through a backup roller 40, a driving roller 41 and a tension roller 42. The backup roller 40 includes a driving section (not shown). The printer section 18 rotates the intermediate transfer belt 21 in a direction indicated by an arrow m.

The printer section 18 is provided with four image forming stations 22Y, 22M, 22C and 22K. Image forming stations 22Y, 22M, 22C and 22K are respectively used to form Y (Yellow), M (Magenta), C (Cyan) and K (Black) images. The image forming stations 22Y, 22M, 22C and 22K are arranged in parallel to each other along the rotary direction of the intermediate transfer belt 21 below the intermediate transfer belt 21.

The printer section 18 includes cartridges 23Y, 23M, 23C and 23K above the image forming stations 22Y, 22M, 22C and 22K, respectively. The cartridges 23Y, 23M, 23C and 23K store Y (Yellow), M (Magenta), C (cyan) and K (black) toner for replenishing, respectively.

Hereinafter, the image forming station 22Y which forms a Y (Yellow) image among the image forming stations 22Y, 22M, 22C and 22K is exemplified. Further, the constitution of the image forming stations 22M, 22C and 22K is identical to that of the image forming station 22Y, and therefore the detailed description thereof is not provided.

The image forming station 22Y comprises an electrostatic charger 26, an exposure scanning head 27, a developing device 28 and a photoconductor cleaner 29. The electrostatic charger 26, the exposure scanning head 27, the developing device 28 and the photoconductor cleaner 29 are arranged around a photoconductive drum 24 rotating in a direction indicated by an arrow n.

The image forming station 22Y is provided with a primary transfer roller 30. The primary transfer roller 30 faces the photoconductive drum 24 across the intermediate transfer belt 21.

The image forming station 22Y is exposed by the exposure scanning head 27 after the photoconductive drum 24 is charged by the electrostatic charger 26. The image forming station 22Y forms an electrostatic latent image on the photoconductive drum 24. The developing device 28 develops the electrostatic latent image on the photoconductive drum 24 using a two-component developing agent consisting of toner and carrier.

The primary transfer roller 30 primarily transfers a toner image formed on the photoconductive drum 24 to the intermediate transfer belt 21. The image forming stations 22Y, 22M, 22C and 22K form a color toner image on the intermediate transfer belt 21 through the primary transfer roller 30. The color toner image is formed by sequentially overlapping a Y (Yellow) toner image, an M (Magenta) toner image, a C (Cyan) toner image and a K (Black) toner image. The photoconductor cleaner 29 removes the toner remained on the photoconductive drum 24 after the primary transfer.

The printer section 18 is provided with a secondary transfer roller 32. The secondary transfer roller 32 faces the backup roller 40 across the intermediate transfer belt 21. The secondary transfer roller 32 secondarily transfers the color toner image on the intermediate transfer belt 21 to the sheet P. The sheet P is fed by the sheet feed cassette section 16 or the manual sheet feed tray 17 along a conveyance path 33.

The printer section 18 is provided with a belt cleaner 43 which faces the driving roller 41 across the intermediate transfer belt 21. The belt cleaner 43 removes the toner remained on the intermediate transfer belt 21 after the second transfer. Further, the image forming section includes the intermediate transfer belt 21, the four image forming stations (22Y, 22M, 22C and 22K) and the transfer roller 30.

The printer section 18 includes a register roller 33*a*, the secondary transfer roller 32, a fixing device 34 (fixing section) and a sheet discharge roller 36 along the conveyance path 33. The printer section 18 comprises the fixing device 34 at the downstream side of the secondary transfer roller 32. The printer section 18 comprises a bifurcating section 37 and a reverse conveyance section 38 at the downstream side of the fixing device 34. The bifurcating section 37 sends the sheet P subjected to a fixing processing to the sheet discharge section 20 or the reverse conveyance section 38. In a case of duplex printing, the reverse conveyance section 38 reveres the sheet P sent from the bifurcating section 37 to the direction of the register roller 33*a* and conveys the sheet P. The MFP 10 forms a fixed toner image on the sheet P by the printer section 18. The MFP 10 discharges the sheet P on which the fixed toner image is formed to the sheet discharge section 20.

Further, the MFP 10 is not limited to an image forming apparatus of a tandem developing system. Moreover, no limitation is given to the number of the developing device 28 of the MFP 10. In addition, the MFP 10 may transfer the toner image to the sheet P from the photoconductive drum 24 directly.

Figure 2:
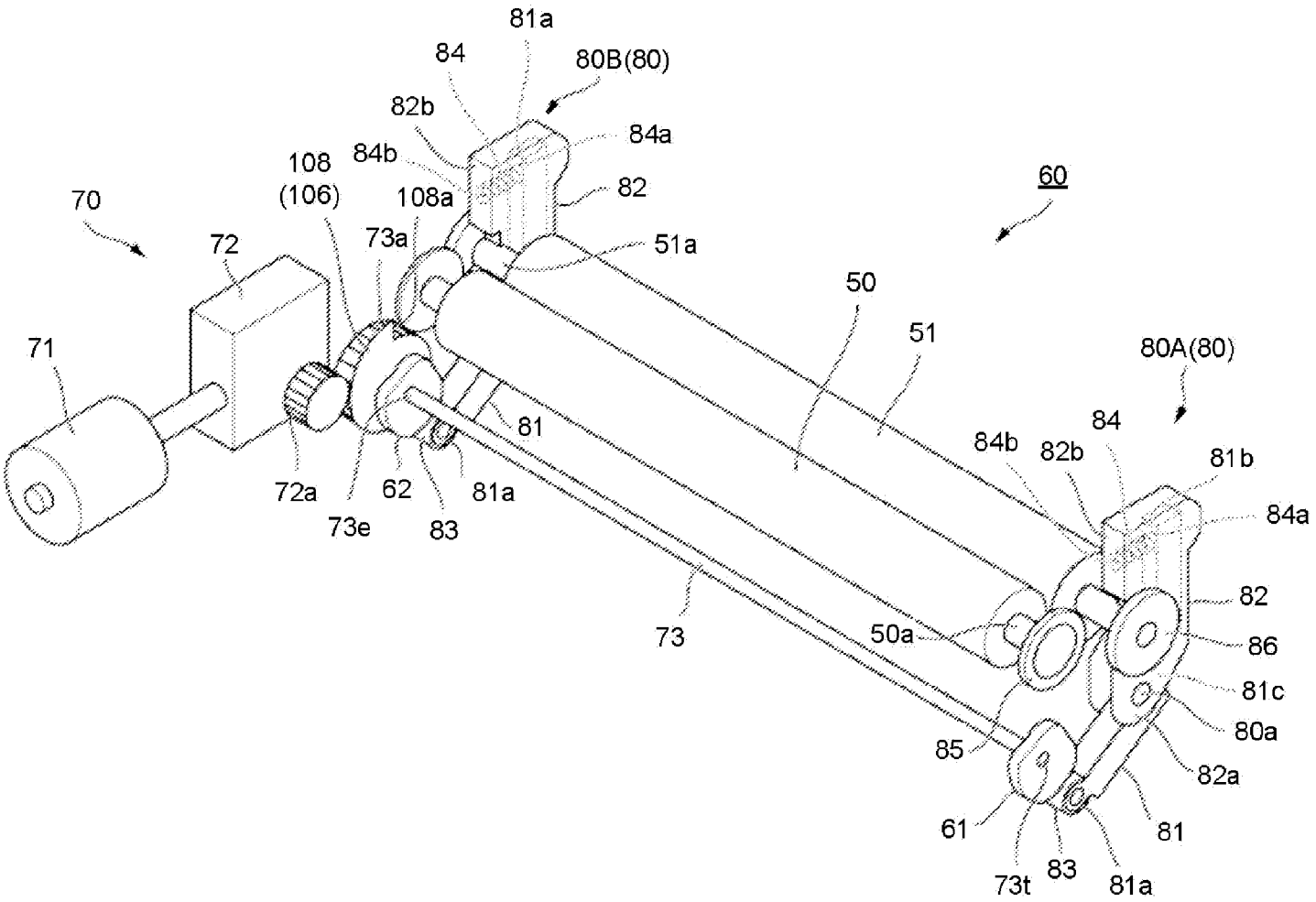
FIG. 2 is a perspective view illustrating a switching mechanism according to the embodiment.

The fixing device 34 comprises a heat roller 50, a press roller 51 and a switching mechanism 60 (refer to FIG. 2). The press roller 51 is a first roller. The heat roller 50 is a second roller facing the press roller 51. The fixing device 34 fixes the toner image on the sheet P through heat of the heat roller 50 and pressure of the press roller 51. The heat roller 50 is formed into a cylindrical shape. The heat roller 50 includes a roller made of metal. For example, the heat roller 50 includes a resin layer consisting of fluororesin and the like on the outer peripheral surface of a roller made of aluminum having a thickness of about 0.8 mm. The heat roller 50 is driven by the press roller 51 to rotate in a direction indicated by an arrow U. Alternatively, the heat roller 50 may be separated from the press roller 51 to rotate in the direction indicated by the arrow U.

The press roller 51 is a pressurization section which presses the heat roller 50. The press roller 51 presses the heat roller 50 through the switching mechanism 60. The press roller 51 rotates in a direction indicated by an arrow q through a motor (not shown). For example, the press roller 51 includes an elastic layer such as a silicon rubber on the outer peripheral surface of a roller made of iron. The heat roller 50 faces the press roller 51. A nip 54 is formed between the heat roller 50 and the press roller 51. The sheet P passes through the nip 54 between the heat roller 50 and the press roller 51 along the conveyance path 33.

The heat roller 50 includes a lamp 52 as a heating section. The lamp 52 is positioned in an area surrounded by the heat roller 50. The lamp 52 heats the heat roller 50. The lamp 52 faces the press roller 51 in the thickness direction thereof. The lamp 52 has a length in a width direction of the heat roller 50 (hereinafter referred to as a "roller width direction"). It is assumed that the length in the longitudinal direction of the lamp 52 is almost the same as the length in the roller width direction of the heat roller 50.

The switching mechanism 60 is arranged inside the fixing device 34. The switching mechanism 60 switches positions of the press roller 51. The switching mechanism 60 moves the press roller 51 towards the heat roller 50. Further, the heat roller 50 doesn't move towards the press roller 51. That is, the position of the heat roller 50 is a fixed position.

Hereinafter, the switching mechanism 60 is described.

FIG. 2 is a perspective view illustrating the switching mechanism 60 according to the embodiment. For facilitating the description, the heat roller 50 and the press roller 51 are shown in FIG. 2.

As shown in FIG. 2, the heat roller 50 and the press roller 51 face each other in the radial direction. The heat roller 50 and the press roller 51 are arranged to extend in parallel to each other.

Supporting members 85 are arranged at both ends of a rotation axis 50*a* of the heat roller 50. The supporting members 85 are supported by a frame (not shown) in a rotatable manner. It is assumed that the heat roller 50 can be rotated with respect to the frame (not shown) through the supporting members 85.

Supporting members 86 are arranged at both ends of a rotation axis 51*a* of the press roller 51. The supporting members 86 are supported by a second arm 82 described later in a rotatable manner. It is assumed that the press roller 51 can be rotated with respect to the second arm 82 through the supporting members 86.

The switching mechanism 60 comprises cams 61 and 62, a driving section 70 and a holding section 80.

The cams 61 and 62 switch the positions of the press roller 51. The positions of the press roller 51 switched by the switching mechanism 60 includes a separation position, a contact position and a semi-contact position which are described later. Hereinafter, the cam 61 is referred to as a "first cam 61". Moreover, the cam 62 is referred to as a "second cam 62".

Hereinafter, the positions of the press roller 51 are described.

Figure 3:
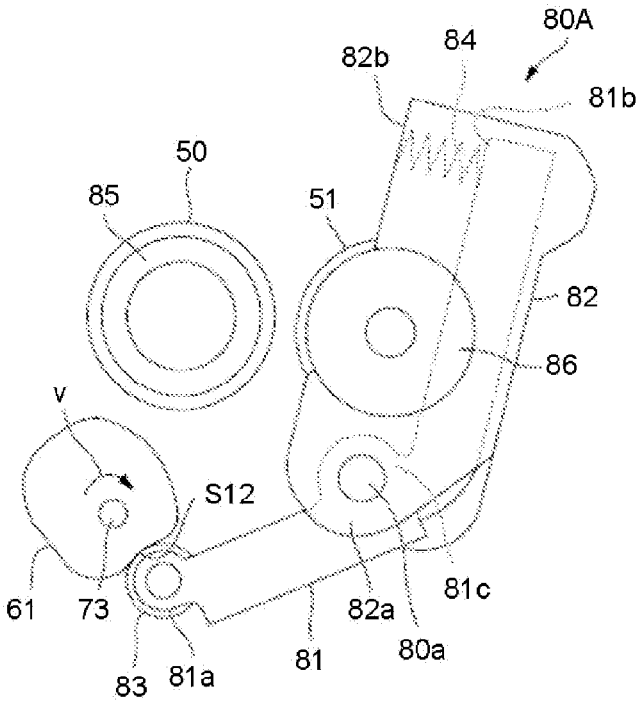
FIG. 3 is a side view illustrating a separation position of a press roller according to the embodiment.
Figure 4:
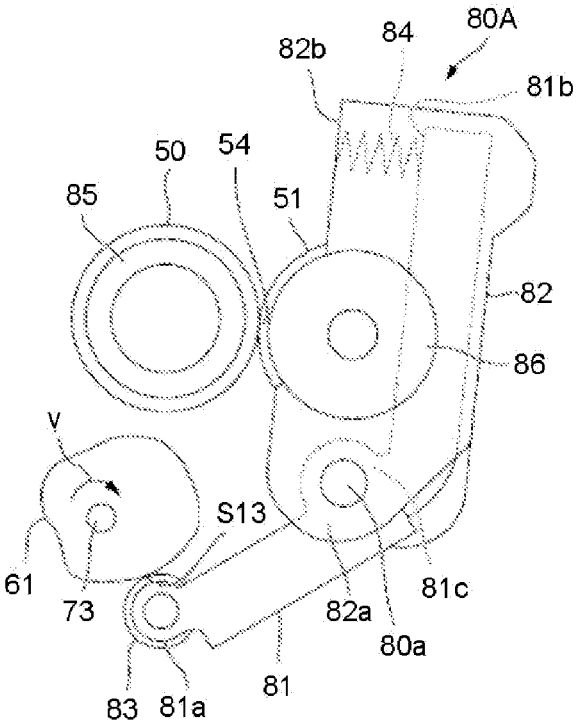
FIG. 4 is a side view illustrating a semi-contact position of the press roller according to the embodiment.
Figure 5:
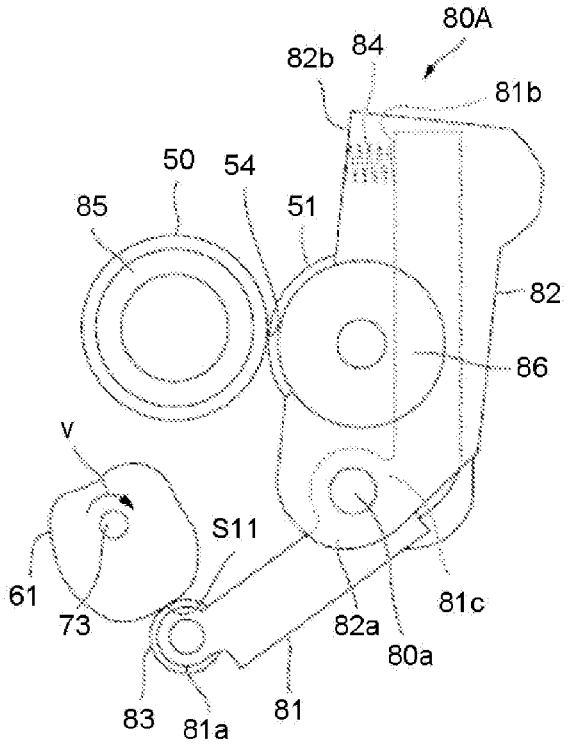
FIG. 5 is a side view illustrating a contact position of the press roller according to the embodiment.

FIG. 3 is a side view illustrating the separation position of the press roller 51 according to the embodiment. FIG. 4 is a side view illustrating the semi-contact position of the press roller 51 according to the embodiment. FIG. 5 is a side view illustrating the contact position of the press roller 51 according to the embodiment. For facilitating the description, side views of a first holding section 80A and the first cam 61 are illustrated in FIG. 3~FIG. 5. Further, it is assumed that the position of the heat roller 50 is a fixed position in FIG. 3~FIG. 5.

As shown in FIG. 3, the press roller 51 separates from the heat roller 50. For example, it is assumed that the switching mechanism 60 switches the position of the press roller 51 to the separation position at the non-sheet-passing time.

As shown in FIG. 4 and FIG. 5, the press roller 51 contacts with the heat roller 50. The nip 54 is formed between the heat roller 50 and the press roller 51.

The press roller 51 shown in FIG. 5 is contacted with the heat roller 50 at a first pressing force. At the contact position, the press roller 51 contacts with the heat roller 50 at the first pressing force. Hereinafter, the time when the press roller 51 contacts with the heat roller 50 at the first pressing force is referred to as a "contact time".

The press roller 51 shown in FIG. 4 is contacted with the heat roller 50 at a second pressing force. The second pressing force is smaller than the first pressing force. A position where the press roller 51 contacts with the heat roller 50 at the second pressing force is referred to as a "semi-contact position". Hereinafter, the time when the press roller 51 contacts with the heat roller 50 at the second pressing force is referred to as a "semi-contact time".

For example, information of normal paper, thick paper and the like serving as the information of the sheet P is set. For example, it is assumed that the normal paper is a copier paper having a thickness of about 0.09 mm. For example, it is assumed that the thick paper is a postcard having a thickness of about 0.25 mm. Alternatively, it is assumed that the thick paper is an envelope having a thickness of about 0.16 mm. The information of the sheet P is input by the user through the control panel 13 (refer to FIG. 1). Further, the information of the sheet P may also be read by the scanner 12 (refer to FIG. 1), a sensor (not shown) and the like.

The sensor is arranged enroute on the conveyance path 33. The sensor detects a front end (downstream end) and a rear end (upstream end) of the sheet P and the thickness of the sheet P. The sensor specifies the category of the sheet P based on the detection result of the sheet P. The control panel 13, the scanner 12 and the sensor are an input section for inputting the information of the sheet P.

For example, in a case of setting a normal paper as the information of the sheet P, the switching mechanism 60 switches the position of the press roller 51 to the contact position. For example, in a case of setting an envelope as the information of the sheet P, the switching mechanism 60 switches the position of the press roller 51 to the semi-contact position.

In the present embodiment, the press roller 51 temporarily moves close to the heat roller 50 during a period of time the press roller 51 is separating from the heat roller 50.

Figure 6:
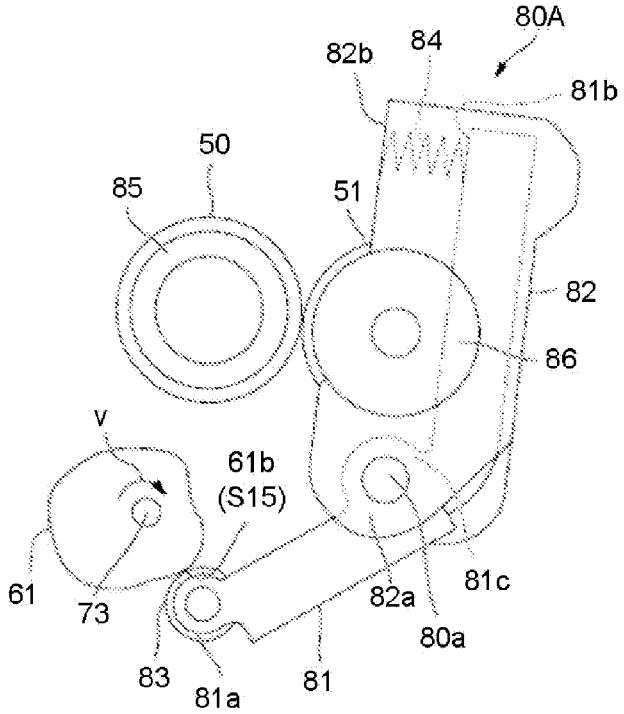
FIG. 6 is a side view illustrating a position where the press roller is moved close to a heat roller temporarily during a period of time the press roller is separating from the heat roller according to the embodiment.

FIG. 6 is a side view illustrating a position where the press roller 51 is moved close to a heat roller 50 temporarily during a period of time the press roller 51 is separating from the heat roller 50 according to the embodiment. For facilitating the description, side views of the first holding section 80A and the first cam 61 are illustrated in FIG. 6. Further, it is assumed that the position of the heat roller 50 is a fixed position in FIG. 6. Hereinafter, a position where the press roller 51 is moved close to the heat roller 50 temporarily during a period of time the press roller 51 is separating from the heat roller 50 is called as a "fluctuation position". Hereinafter, a time when the press roller 51 is moved close to a heat roller 50 temporarily during a period of time the press roller 51 is separating from the heat roller 50 is referred to as a "fluctuation time". Herein, the "temporarily move close to" means that the press roller 51 moves close to the heat roller 50 again from the contact position to the separation position. Further, it is assumed that the fluctuation position is a fifth cam position P5 which is described later (refer to FIG. 9 and FIG. 10).

As shown in FIG. 6, the press roller 51 separates from the heat roller 50 slightly at the fluctuation position. The press roller 51 shown in FIG. 6 is closer than the press roller 51 at the separation position (refer to FIG. 3) to the heat roller 50.

Hereinafter, the first cam 61 and the second cam 62 are described.

Figure 7:
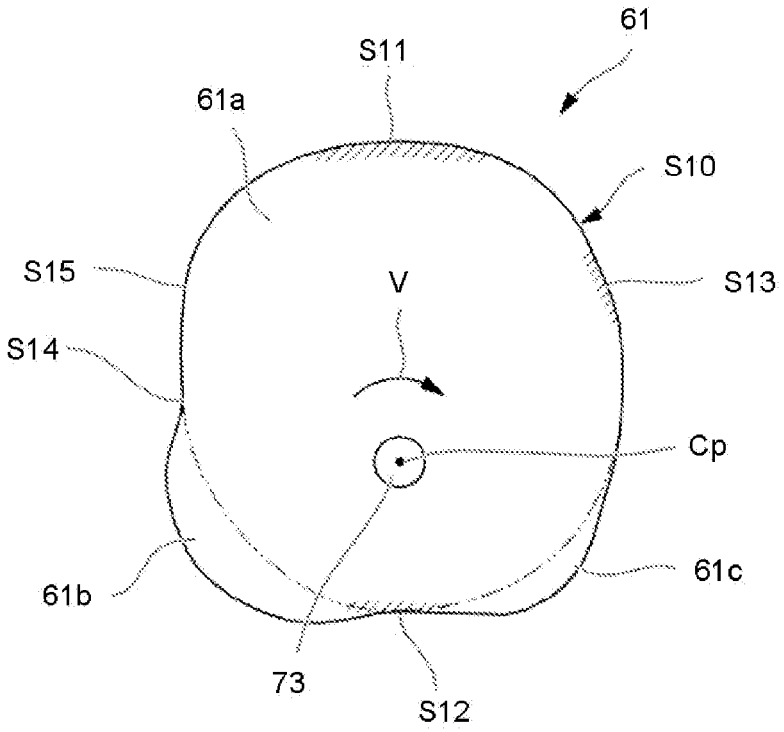
FIG. 7 is an illustration diagram of a first cam according to the embodiment.
Figure 8:
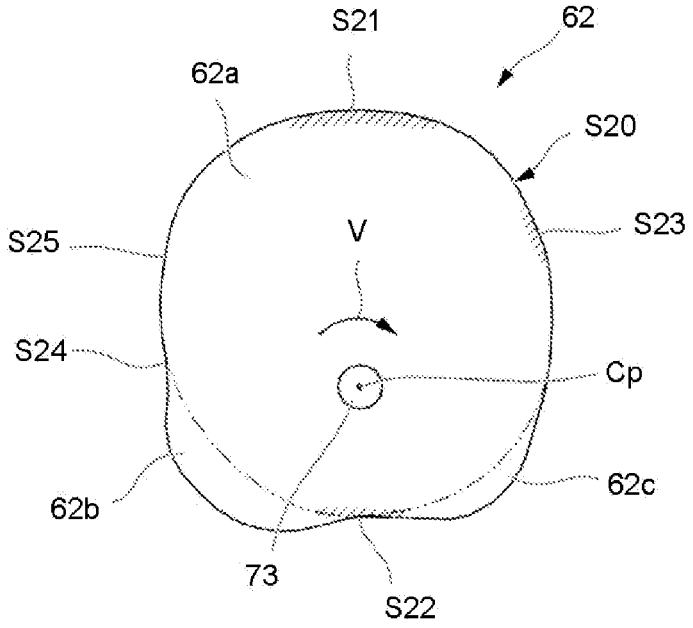
FIG. 8 is an illustration diagram of a second cam according to the embodiment.
Figure 9:
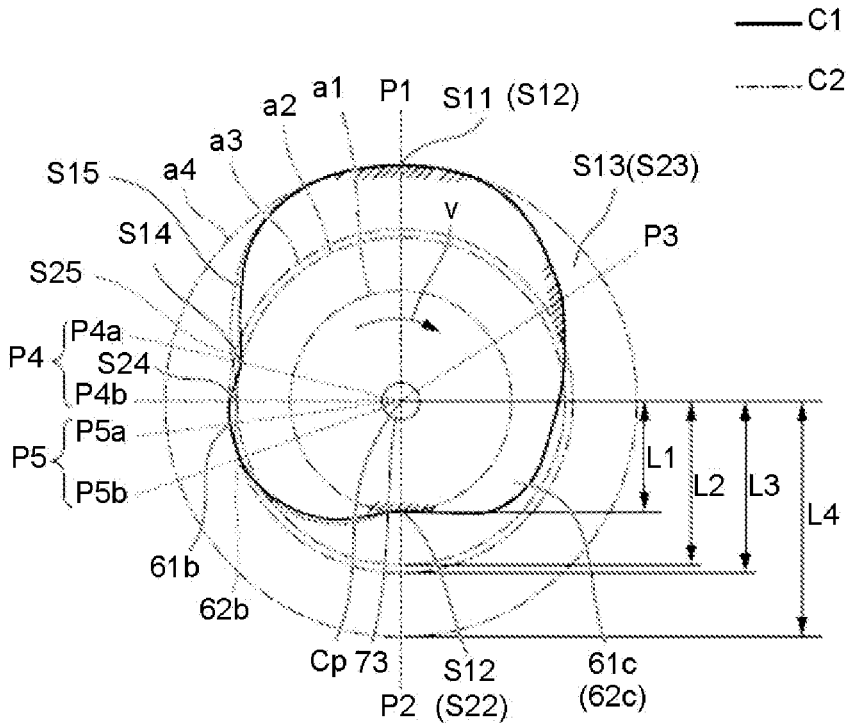
FIG. 9 is an illustration diagram of the first cam and the second cam according to the embodiment.

FIG. 7 is an illustration diagram of a first cam 61 according to the embodiment. FIG. 8 is an illustration diagram of a second cam 62 according to the embodiment. FIG. 9 is an illustration diagram of the first cam 61 and the second cam 62 according to the embodiment. Hereinafter, axes Cp around which the first cam 61 and the second cam 62 rotate are referred as "rotation axes".

For facilitating the description, a plurality of virtual circles a1~a4 by taking the rotation axis Cp as a center are illustrated in FIG. 9. The plurality of virtual circles a1~a4 is located concentrically when viewed from a direction along the rotation axis Cp. As the plurality of virtual circles a1~a4, a first virtual circle a1, a second virtual circle a2, a third virtual circle a3 and a fourth virtual circle a4 are exemplified. It is assumed that the first virtual circle a1 is a base circle of the first cam 61 and the second cam 62. The first virtual circle a1 has a first outer diameter L1. The second virtual circle a2 has a second outer diameter L2 larger than the first outer diameter L1. The third virtual circle a3 has a third outer diameter L3 larger than the second outer diameter L2. The fourth virtual circle a4 has a fourth outer diameter L4 larger than the third outer diameter L3. Further, in FIG. 9, cam positions P1~P5 where the positions of the press roller 51, the fluctuation position and the like are set are illustrated. Hereinafter, a "cam position" means a position P on a cam surface displaced through the rotation of the first cam 61 and the second cam 62 taking the rotation axis Cp as the center. The cam positions include a first cam position P1, a second cam position P2, a third cam position P3, a fourth cam position P4 and a fifth cam position P5. It is assumed that the first cam position P1 is the contact position, the second cam position P2 is the separation position, the third cam position P3 is the semi-contact position, the fourth cam position P4 is a boundary position described later, and the fifth cam position P5 is a position functioning as the fluctuation position.

Hereinafter, the first cam 61 is described.

As shown in FIG. 7 and FIG. 9, the first cam 61 includes a first cam surface S10. The first cam surface S10 is smoothly continuous in a rotation direction v (driving direction) of the first cam 61. The first cam 61 includes a first position regulating section S11, a second position regulating section S12, a third position regulating section S13 and a position changing section S15. The first position regulating section S11, the second position regulating section S12 and the third position regulating section S13 are positioned at intervals in the rotation direction v of the first cam 61.

The first position regulating section S11 sets the contact position among the positions of the press roller 51 switched by the switching mechanism 60. When viewed from the direction along the rotation axis Cp, the first position regulating section S11 is overlapped with the first cam position P1 in the fourth virtual circle a4. When viewed from the direction along the rotation axis Cp, the first position regulating section S11 is gently curved such that a convex is formed at the outer peripheral side of the first cam 61.

The second position regulating section S12 is positioned at a side opposite to the first position regulating section S11 in the first cam 61. A line part (not shown) connecting the first position regulating section S11 with the second position regulating section S12 forms a long axis of the first cam 61. The second position regulating section S12 sets the separation position among the positions of the press roller 51 switched by the switching mechanism 60. When viewed from the direction along the rotation axis Cp, the second position regulating section S12 is overlapped with the second cam position P2 in the first virtual circle a1. When viewed from the direction along the rotation axis Cp, the second position regulating section S12 is curved such that a convex is formed at the inner peripheral side of the first cam 61.

The third position regulating section S13 sets the semi-contact position among the positions of the press roller 51 switched by the switching mechanism 60. When viewed from the direction along the rotation axis Cp, the third position regulating section S13 is overlapped with the third cam position P3 between the third virtual circle a3 and the fourth virtual circle a4. When viewed from the direction along the rotation axis Cp, the third position regulating section S13 is gently curved such that a convex is formed at the outer peripheral side of the first cam 61.

The position changing section S15 is positioned between the first position regulating section S11 and the second position regulating section S12 in the rotation direction v of the first cam 61. The position changing section S15 includes a fluctuation section for setting the fluctuation position. The position changing section S15 includes a protruding section 61*b* as a first fluctuation section (fluctuation section). When viewed from the direction along the rotation axis Cp, the protruding section 61*b* is overlapped with a fifth cam position P5*a* in the third virtual circle a3. When viewed from the direction along the rotation axis Cp, the protruding section 61*b* is gently curved such that a convex is formed at the outer peripheral side of the first cam 61.

The position changing section S15 includes a boundary section S14. The boundary section S14 is positioned between the first position regulating section S11 and the protruding section 61*b* in the rotation direction v of the first cam 61. The boundary section S14 is positioned at the downstream side of the protruding section 61*b* in the rotation direction v of the first cam 61. Hereinafter, the position of the boundary section S14 is referred to as a "boundary position". When viewed from the direction along the rotation axis Cp, the boundary section S14 is overlapped with a fourth cam position P4*a* in the second virtual circle a2.

The first cam 61 includes a cam main body 61*a*, the protruding section 61*b* and a position regulating section forming section 61*c*. For facilitating the description, a boundary part of the cam main body 61*a*, the protruding section 61*b* and the position regulating section forming section 61*c* is represented by two dotted lines in FIG. 7. It is assumed that the first cam 61 is a plate cam having a thickness in a direction parallel to the rotation axis Cp. The first cam 61 switches the position at the first end of the press roller 51.

When viewed from the direction along the rotation axis Cp, the protruding section 61*b* protrudes towards the outer peripheral side of the first cam 61. When viewed from the direction along the rotation axis Cp, the protruding section 61*b* is curved such that a convex is formed at the outer peripheral side of the first cam 61. When viewed from the direction along the rotation axis Cp, the protruding section 61*b* has an arc shape in which a convex is formed at the outer peripheral side of the first cam 61.

When viewed from the direction along the rotation axis Cp, the position regulating section forming section 61*c* is positioned at the upstream side of the protruding section 61*b* in the rotation direction v. The second position regulating section S12 is formed between the position regulating section forming section 61*c* and the protruding section 61*b* in the rotation direction v of the first cam 61. The second position regulating section S12 extends over the upstream end of the protruding section 61*b* and the downstream end of the position regulating section forming section 61*c* in the rotation direction v of the first cam 61. The position regulating section forming section 61*c* protrudes towards the outer peripheral side of the first cam 61. When viewed from the direction along the rotation axis Cp, the position regulating section forming section 61*c* is curved such that a convex is formed at the outer peripheral side of the first cam 61. The position regulating section forming section 61*c* is curved more gently than the protruding section 61*b*. The protruding amount of the position regulating section forming section 61*c* is smaller than that of the protruding section 61*b*.

In the first cam 61, the cam main body 61*a*, the protruding section 61*b* and the position regulating section forming section 61*c* are formed integrally by the same material.

Hereinafter, the second cam 62 is described.

As shown in FIG. 8 and FIG. 9, the second cam 62 has a second cam surface S20 different from the first cam surface S10. The second cam surface S20 is smoothly continuous in the rotation direction v of the second cam 62. The second cam 62 includes a first position regulating section S21, a second position regulating section S22, a third position regulating section S23 and a position changing section S25. The first position regulating section S21, the second position regulating section S22 and the third position regulating section S23 are positioned at intervals in the rotation direction v of the second cam 62. When viewed from the direction along the rotation axis Cp, the second cam 62 has a shape different from the first cam 61 between the first position regulating section S21 and the second position regulating section S22 in the rotation direction v. That is, when viewed from the direction along the rotation axis Cp, the position changing section S25 of the second cam 62 has a shape different from the position changing section S15 of the first cam 61. In other words, when viewed from the direction along the rotation axis Cp, the part of the second cam 62 excluding the position changing section S25 has a same shape as the part of the first cam 61 excluding the position changing section S15.

The first position regulating section S21 sets the contact position among the positions of the press roller 51 switched by the switching mechanism 60. When viewed from the direction along the rotation axis Cp, the first position regulating section S21 is overlapped with the first cam position P1 in the fourth virtual circle a4. When viewed from the direction along the rotation axis Cp, the first position regulating section S21 is gently curved such that a convex is formed at the outer peripheral side of the second cam 62. When viewed from the direction along the rotation axis Cp, the first position regulating section S21 of the second cam 62 is consistent with the first position regulating section S11 of the first cam 61 in the fourth virtual circle a4.

The second position regulating section S22 is positioned at a side opposite to the first position regulating section S21 in the second cam 62. A line part (not shown) connecting the first position regulating section S21 with the second position regulating section S22 forms a long axis of the second cam 62. The second position regulating section S22 sets the separation position among the positions of the press roller 51 switched by the switching mechanism 60. When viewed from the direction along the rotation axis Cp, the second position regulating section S22 is overlapped with the second cam position P2 in the first virtual circle a1. When viewed from the direction along the rotation axis Cp, the second position regulating section S22 is curved such that a convex is formed at the inner peripheral side of the second cam 62. When viewed from the direction along the rotation axis Cp, the second position regulating section S22 of the second cam 62 is consistent with the second position regulating section S12 of the first cam 61 in the first virtual circle a1.

The third position regulating section S23 sets the semi-contact position among the positions of the press roller 51 switched by the switching mechanism 60. When viewed from the direction along the rotation axis Cp, the third position regulating section S23 is overlapped with the third cam position P3 between the third virtual circle a3 and the fourth virtual circle a4. When viewed from the direction along the rotation axis Cp, the third position regulating section S23 is gently curved such that a convex is formed at the outer peripheral side of the second cam 62. When viewed from the direction along the rotation axis Cp, the third position regulating section S23 of the second cam 62 is consistent with the third position regulating section S13 of the first cam 61.

The position changing section S25 is positioned between the first position regulating section S21 and the second position regulating section S22 in the rotation direction v of the second cam 62. The position changing section S25 includes a fluctuation section for setting the fluctuation position. The position changing section S25 includes a protruding section 62*b* as a second fluctuation section (fluctuation section). When viewed from the direction along the rotation axis Cp, the protruding section 62*b* is overlapped with a fifth cam position P5*b* in the third virtual circle a3. When viewed from the direction along the rotation axis Cp, the protruding section 62*b* is gently curved such that a convex is formed at the outer peripheral side of the second cam 62. When viewed from the direction along the rotation axis Cp, the protruding section 62*b* of the second cam 62 is deviated with respect to the protruding section 61*b* of the first cam 61 at the upstream side in the rotation direction v of the second cam 62. Further, when viewed from the direction along the rotation axis Cp, the protruding section 62*b* of the second cam 62 may be deviated from the protruding section 61*b* of the first cam 61 at the downstream side in the rotation direction v of the second cam 62.

The position changing section S25 includes a boundary section S24. The boundary section S24 is positioned between the first position regulating section S21 and the protruding section 62*b* in the rotation direction v of the second cam 62. The boundary section S24 is positioned at the downstream side of the protruding section 62*b* in the rotation direction v of the second cam 62. Hereinafter, the position of the boundary section S24 is referred to as a "boundary position". When viewed from the direction along the rotation axis Cp, the boundary section S24 is overlapped with the fourth cam position P4*b* in the second virtual circle a2. When viewed from the direction along the rotation axis Cp, the boundary section S24 of the second cam 62 is deviated with respect to the boundary section S14 of the first cam 61 at the upstream side in the rotation direction v of the second cam 62. Further, when viewed from the direction along the rotation axis Cp, the boundary section S24 of the second cam 62 may be deviated from the boundary section S14 of the first cam 61 at the downstream side in the rotation direction v of the second cam 62.

The second cam 62 includes a cam main body 62*a*, the protruding section 62*b* and a position regulating section forming section 62*c*. For facilitating the description, a boundary part of the cam main body 62*a*, the protruding section 62*b* and the position regulating section forming section 62*c* is represented by two dotted lines in FIG. 8. It is assumed that the second cam 62 is a plate cam having a thickness in a direction parallel to the rotation axis Cp. The second cam 62 switches the position at the second end of the press roller 51.

When viewed from the direction along the rotation axis Cp, the protruding section 62*b* protrudes towards the outer peripheral side of the second cam 62. When viewed from the direction along the rotation axis Cp, the protruding section 62*b* is curved such that a convex is formed at the outer peripheral side of the second cam 62. When viewed from the direction along the rotation axis Cp, the protruding section 62*b* has an arc shape in which a convex is formed at the outer peripheral side of the second cam 62. When viewed from the direction along the rotation axis Cp, the protruding section 62*b* of the second cam 62 has the arc shape different from that of the protruding section 61*b* of the first cam 61.

When viewed from the direction along the rotation axis Cp, the position regulating section forming section 62*c* is positioned at the upstream side of the protruding section 62*b* in the rotation direction v. The second position regulating section S22 is formed between the position regulating section forming section 62*c* and the protruding section 62*b* in the rotation direction v of the second cam 62. The second position regulating section S22 extends over the upstream end of the protruding section 62*b* and the downstream end of the position regulating section forming section 62*c* in the rotation direction v of the second cam 62. The position regulating section forming section 62*c* protrudes towards the outer peripheral side of the second cam 62. When viewed from the direction along the rotation axis Cp, the position regulating section forming section 62*c* is curved such that a convex is formed at the outer peripheral side of the second cam 62. The position regulating section forming section 62*c* is curved more gently than the protruding section 62*b*. The protruding amount of the position regulating section forming section 62*c* is smaller than that of the protruding section 62*b*. When viewed from the direction along the rotation axis Cp, the position regulating section forming section 62*c* of the second cam 62 has a same shape as the position regulating section forming section 61*c* of the first cam 61.

In the second cam 62, the cam main body 62*a*, the protruding section 62*b* and the position regulating section forming section 62*c* are formed integrally by the same material.

In the contact position, the outer diameter of the first cam 61 and the second cam 62 is the largest. The outer diameter of the first cam 61 and the second cam 62 is gradually decreased from the contact position to the boundary position. The outer diameter of the first cam 61 and the second cam 62 is gradually increased from the boundary position to the fluctuation position. That is, the outer diameter of the first cam 61 and the second cam 62 is gradually decreased from the fluctuation position to the separation position. That is, the outer diameter of the first cam 61 and the second cam 62 is temporarily increased after being decreased gradually from the contact position to the separation position.

In the separation position, the outer diameter of the first cam 61 and the second cam 62 is the smallest. The outer diameter of the first cam 61 and the second cam 62 is gradually increased from the separation position to the semi-contact position. The outer diameter of the first cam 61 and the second cam 62 is gradually increased from the semi-contact position to the contact position.

The first cam 61 and the second cam 62 rotate through the driving of the driving section 70. Hereinafter, the driving section 70 is described.

As shown in FIG. 2, the driving section 70 comprises, a direct-current motor 71 (DC motor), a gear box 72 and a cam shaft 73.

It is set that the DC motor 71 can rotate in one direction. In this way, the electrical element for controlling the rotation direction is not required, thus reducing the cost. Further, it may be set that the DC motor 71 rotates in both the forward direction and the reverse direction.

The DC motor 71 has no function of controlling the motor speed. The DC motor 71 has a T-I (torque versus current) characteristic in which torque is linearly proportional to the input current. The DC motor 71 has a T-N (torque versus number of rotation) characteristic in which number of rotation is linearly inversely proportional to the torque. For example, the DC motor 71 is set to a brush motor.

The gear box 72 has a plurality of gears including a gear 72*a*. The plurality of gears are meshed with each other. As a result, the gear box 72 decelerates the rotation speed of the DC motor 71.

The cam shaft 73 extends in parallel to the roller width direction. The cam shaft 73 includes a first end 73*t* and a second end 73*e*. The first cam 61 is fixed at the first end 73*t* of the cam shaft 73. The second cam 62 is fixed at the second end 73*e* of the cam shaft 73. The first cam 61 and the second cam 62 rotate integrally together with the cam shaft 73. The protruding section 61*b* (refer to FIG. 7) of the first cam 61 and the protruding section 62*b* (refer to FIG. 8) of the second cam 62 differ from each other in the phase.

Hereinafter, a phase difference of the first cam 61 and the second cam 62 is described. As shown in FIG. 9, the first cam 61 and the second cam 62 rotate integrally taking the cam shaft 73 as a shaft. When viewed from the direction along the rotation axis Cp, it is assumed that the positions of the first position regulating section S11 of the first cam 61 and the second position regulating section S21 of the second cam 62 is a phase reference in which there is no phase difference.

At the time of the phase reference, there is no phase difference between the second position regulating section S12 of the first cam 61 and the second position regulating section S22 of the second cam 62. At the time of the phase reference, there is no phase difference between the third position regulating section S13 of the first cam 61 and the second position regulating section S23 of the second cam 62. At the time of the phase reference, there is no phase difference between the position regulating section forming section 61*c* of the first cam 61 and the position regulating section forming section 62*c* of the second cam 62.

On the other hand, at the time of the phase reference, there is a phase difference between the position changing section S15 of the first cam 61 and the position changing section S25 of the second cam 62. Specifically, at the time of the phase reference, there is a phase difference between the protruding section 61*b* of the first cam 61 and the protruding section 62*b* of the second cam 62. At the time of the phase reference, there is a phase difference between the boundary section S14 of the first cam 61 and the boundary section S24 of the second cam 62.

As shown in FIG. 2, a gear 73*a* is installed on the second end 73*e* of the cam shaft 73. The gear 73*a* is positioned at the further outer side than the second cam 62 in the longitudinal direction of the cam shaft 73.

A rotation position detection section 106 is installed on the second end 73*e* of the cam shaft 73. The rotation position detection section 106 is provided with a light shielding plate 108 and an optical sensor 107 (refer to FIG. 11). The light shielding plate 108 is positioned between the second cam 62 and the gear 73*a* in the longitudinal direction of the cam shaft 73. The optical sensor 107 emits light to the light shielding plate 108 to detect the position of the light shielding plate 108.

The gear 73*a* of the cam shaft 73 is meshed with a gear 72*a* of the gear box 72. The gear 73*a* is rotated through the rotation of the DC motor 71. The gear 73*a*, the cam shaft 73, the light shielding plate 108, the first cam 61 and the second cam 62 rotate integrally. Through the rotation of the DC motor 71, the gear 73*a*, the cam shaft 73, the light shielding plate 108, the first cam 61 and the second cam 62 rotate in both the forward direction and the reverse direction.

Through the rotation of the DC motor 71, the light shielding plate 108 shields the light from the optical sensor 107. Alternatively, through the rotation of the DC motor 71, the light shielding plate 108 doesn't shield the light from the optical sensor 107. Specifically, the light from the optical sensor 107 passes through a cutout section 108*a* of the light shielding plate 108 through the rotation of the DC motor 71.

For example, the optical sensor 107 detects a signal when the light passes through the cutout section 108*a* as a bright signal. The optical sensor 107 detects a signal when the light shielding plate 108 shields the light as a dark signal. The optical sensor 107 detects the rotation positions of the first cam 61 and the second cam 62 according to the bright signal and the dark signal.

The first cam 61 and the second cam 62 are held by the holding section 80. Hereinafter, the holding section 80 is described.

As shown in FIG. 2, the holding section 80 is positioned at both ends of the rotation axis of the press roller 51. The holding section 80 comprises the first holding section 80A and a second holding section 80B. The first holding section 80A is positioned at the first end of the rotation axis of the press roller 51. The second holding section 80B is positioned at the second end of the rotation shaft of the press roller 51. Hereinafter, the first holding section 80A is described. The second holding section 80B has the same constitutions as the first holding section 80A, and therefore the description is not provided.

The first holding section 80A has a swing shaft 80*a* extending in parallel to the roller width direction. The first holding section 80A comprises a first arm 81 and the second arm 82. It is assumed that the first arm 81 and the second arm 82 can swing through the rotation of the swing shaft 80*a*. The switching mechanism 60 maintains the separation position (refer to FIG. 3) through the gravity of the first holding section 80A.

The first arm 81 is formed into an L shape when viewed from the roller width direction. The first arm 81 has a bend section 81*c*. The bend section 81*c* is supported by the swing shaft 80*a* in a swingable manner. When viewed from the roller width direction, the first arm 81 is gently inclined such that it is positioned below the cam shaft 73 starting from the bend section 81*c*. The first arm 81 extends linearly starting from the bend section 81*c*.

The first cam 81 includes a first end 81*a* and a second end 81*b*. It is assumed that the first end 81*a* is an end at the side of the cam shaft 73 of the first cam 61. A cam follower 83 is arranged in a rotatable manner in the first end 81*a*. The first arm 81 supports the cam follower 83 in a rotatable manner. For example, it is assumed that the cam follower 83 is a roller.

It is assumed that the second end 81*b* is an end opposite to the first end 81*a* in the first arm 81. The second end 81*b* is arranged above the press roller 51. An elastic member 84 is installed in the second end 81*b*. For example, the elastic member 84 is a spring. For example, when viewed from the roller width direction, the stretching direction of the spring is set to a direction intersecting with a line (not shown) passing through the center of the rotation axis 51*a* of the press roller 51 and the center of the swing shaft 80*a*.

The second arm 82 supports the press roller 51 in a rotatable manner through the supporting members 86. The second arm 82 is supported by the first arm 81 in a rotatable manner through the swing shaft 80*a* and the elastic member 84.

The second arm 82 covers an upper portion including the bend section 81*c* of the first arm 81. The second arm 82 includes a first end 82*a* and a second end 82*b*. When viewed from the roller width direction, the first end 82*a* overlaps with the bend section 81*c*. The first end 82*a* is supported by the swing shaft 80*a* in a rotatable manner.

It is assumed that the second end 82*b* is an end opposite to the first end 82*a* in the second arm 82. The second end 82*b* is positioned above the press roller 51. The second end 82*b* includes an inner wall surface facing the second end 81*b* of the first arm 81. The elastic member 84 is installed on the inner wall surface of the second end 82*b*. The elastic member 84 extends in one direction. The elastic member 84 includes a first end 84*a* and a second end 84*b*. The first end 84*a* of the elastic member 84 is installed in the second end 81*b* of the first arm 81. The second end 84*b* of the elastic member 84 is installed in the inner wall surface of the second end 82*b* of the second arm 82.

Hereinafter, the cam follower 83 of the first holding section 80A is described.

The cam follower 83 of the first holding section 80A is contacted with the first cam 61. Specifically, at the contact time, the cam follower 83 of the first holding section 80A is contacted with the first position regulating section S11 (refer to FIG. 5) of the first cam 61. At the separation time, the cam follower 83 of the first holding section 80A is contacted with the second position regulating section S12 (refer to FIG. 3) of the first cam 61. At the semi-contact time, the cam follower 83 of the first holding section 80A is contacted with the third position regulating section S13 (refer to FIG. 4) of the first cam 61. At the fluctuation time, the cam follower 83 of the first holding section 80A is contacted with the protruding section 61*b* of the first cam 61 (the fluctuation section of the position changing section S15) (refer to FIG. 6).

The cam follower 83 of the first holding section 80A is driven by the rotation of the first cam 61 to rotate. The elastic member 84 of the first holding section 80A energizes in a direction in which the cam follower 83 is pressed against the first cam 61. Further, the elastic member 84 of the first holding section 80A energizes in a direction in which the press roller 51 is pressed against the heat roller 50.

Hereinafter, the cam follower 83 of the second holding section 80B is described.

The cam follower 83 of the second holding section 80B is contacted with the second cam 62. Specifically, at the contact time, the cam follower 83 of the second holding section 80B is contacted with the first position regulating section S21 of the second cam 62. At the separation time, the cam follower 83 of the second holding section 80B is contacted with the second position regulating section S22 of the second cam 62. At the semi-contact time, the cam follower 83 of the second holding section 80B is contacted with the third position regulating section S23 of the second cam 62. At the fluctuation time, the cam follower 83 of the second holding section 80B is contacted with the protruding section 62*b* of the second cam 62 (the fluctuation section of the position changing section S25).

The cam follower 83 of the second holding section 80B is driven by the rotation of the second cam 62 to rotate. The elastic member 84 of the second holding section 80B energizes in a direction in which the cam follower 83 is pressed against the second cam 62. Further, the elastic member 84 of the second holding section 80B energizes in a direction in which the press roller 51 is pressed against the heat roller 50.

Hereinafter, the switching of the positions of the press roller 51 by the switching mechanism 60 is described.

The switching mechanism 60 switches the positions of the press roller 51 through the rotation of the DC motor 71. In other words, the switching mechanism 60 switches the contact position, the separation position and the semi-contact position of the press roller 51 through the rotation of the DC motor 71.

The elastic member 84 energizes in a direction in which the press roller 51 is pressed against the heat roller 50. The elastic member 84 is compressed according to an amount of swing displacement of the first arm 81 against the second arm 82 when the press roller 51 is pressed against the heat roller 50.

At the contact position, the elastic member 84 is compressed according to a first amount of swing displacement. At the semi-contact position, the elastic member 84 is compressed according to a second amount of swing displacement. The second amount of swing displacement is smaller than the first amount of swing displacement.

The press roller 51 presses the heat roller 50 resiliently through a restoring force of the elastic member 84. The pressing force of the elastic member 84 generates when the press roller 51 is contacted with the heat roller 50.

Figure 10:
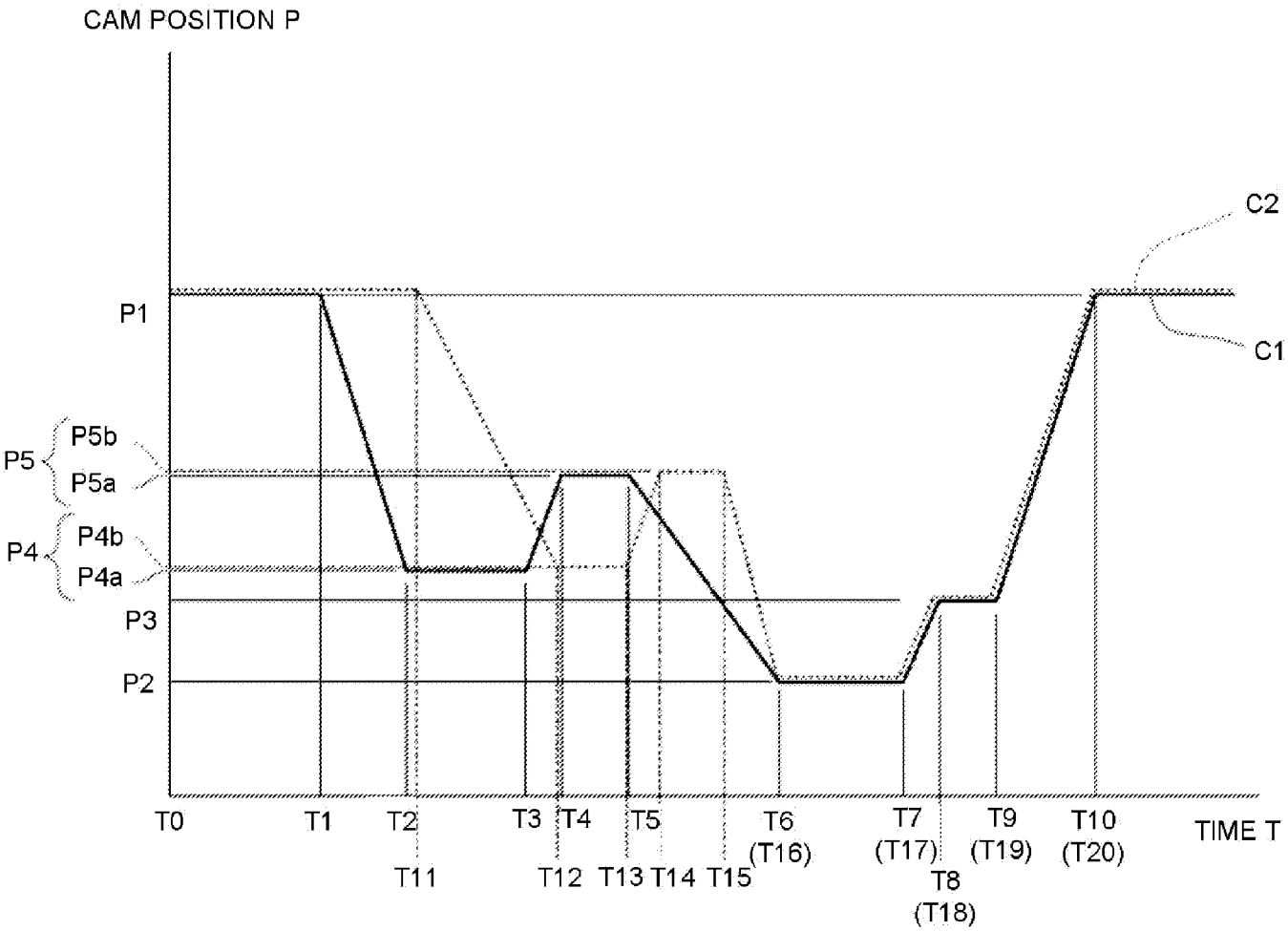
FIG. 10 is a graph illustrating a relation between a time of the first cam and the second cam and a cam position according to the embodiment.

FIG. 10 is a graph illustrating a relation between a cam position P and a time T of the first cam 61 and the second cam 62 according to the embodiment.

Herein, the "time T" means a time the first cam 61 and the second cam 62 rotate when the first cam 61 and the second cam 62 rotate around the rotation axis Cp in the direction indicated by the arrow v at constant speeds. Hereinafter, a distance from the rotation axis Cp to the cam surface S10, S20 displaced through the rotation of the first cam 61 and the second cam 62 around the rotation axis Cp in the direction indicated by the arrow v is referred to as "an amount of cam displacement". That is, the amount of cam displacement means a change of cam ridge when the first cam 61 and the second cam 62 rotate at a constant speed.

Hereinafter, the relation between the time T of the first cam 61 and the second cam 62 and the cam position P is described with reference to FIG. 9 and FIG. 10.

In FIG. 10, a graph C1 indicated by a solid line indicates a relation between the time T of the first cam 61 and the cam position P. A graph C2 indicated by a dotted line illustrates a relation between the time T of the second cam 62 and the cam position P. It is assumed that a time T0 is a time when the first cam 61 and the second cam 62 start to rotate (hereinafter referred to as a "rotation start time"). It is assumed that the first cam position P1 (contact position) when the time T0 is set to a rotation start time is a reference position before the first cam 61 and the second cam 62 rotate.

Hereinafter, as to the time T0 and times T1~T10, the changes of the cam position P of the first cam 61 are mainly described.

As shown in FIG. 9 and FIG. 10, the first cam 61 is maintained at the first cam position P1 from the time T0 to the time T1. From the time T1 to a time T2, the cam position P of the first cam 61 changes. Specifically, from the time T1 to the time T2, the amount of cam displacement is gradually reduced from the first cam position P1 in the fourth virtual circle a4 to a fourth cam position P4*a* in the second virtual circle a2.

The first cam 61 is maintained at the fourth cam position P4*a* from the time T2 to a time T3. From the time T3 to a time T4, the cam position P of the first cam 61 changes. Specifically, from the time T3 to the time T4, the amount of cam displacement is gradually increased from the fourth cam position P4*a* in the second virtual circle a2 to a fifth cam position P5*a* in the third virtual circle a3.

The first cam 61 is maintained at the fifth cam position P5*a* from the time T4 to a time T5. From the time T5 to a time T6, the cam position P of the first cam 61 changes. Specifically, from the time T5 to the time T6, the amount of cam displacement is gradually reduced from the fifth cam position P5*a* in the third virtual circle a3 to a second cam position P2 in the first virtual circle a1.

The first cam 61 is maintained at the second cam position P2 from the time T6 to a time T7. From the time T7 to a time T8, the cam position P of the first cam 61 changes. Specifically, from the time T7 to the time T8, the amount of cam displacement is gradually increased from the second cam position P2 in the first virtual circle a1 to a third cam position P3.

The first cam 61 is maintained at the third cam position P3 from the time T8 to a time T9. From the time T9 to a time T10, the cam position P of the first cam 61 changes. Specifically, from the time T9 to the time T10, the amount of cam displacement is gradually increased from the third cam position P3 to the first cam position P1 in the fourth virtual circle a4.

The first cam 61 repeats the changes of the cam position P described above after the time T10. In other words, the time T10 is equivalent to the time T0.

Hereinafter, as to the time T0 and times T11~T20, the changes of the cam position P of the second cam 62 are mainly described.

As shown in FIG. 9 and FIG. 10, the second cam 62 is maintained at the first cam position P1 from the time T0 to the time T11. By setting an interval from the time T0 to the time T11 to be longer than an interval from the time T0 to the time T1, the second cam 62 is maintained at the first cam position P1 for a period of time longer than that of the first cam 61.

From the time T11 to a time T12, the cam position P of the second cam 62 changes. Specifically, from the time T11 to the time T12, the amount of cam displacement is gradually reduced from the first cam position P1 in the fourth virtual circle a4 to a fourth cam position P4*b* in the second virtual circle a2.

The second cam 62 is maintained at the fourth cam position P4*b* from the time T12 to a time T13. By setting the time T12 to be longer than the time T3, a maintained time of the fourth cam position P4*b* of the second cam 62 is deviated with respect to a maintained time of the fourth cam position P4*a* of the first cam 61. That is, the maintained time of the fourth cam position P4*b* of the second cam 62 is delayed in time with respect to the maintained time of the fourth cam position P4*a* of the first cam 61.

From the time T13 to a time T14, the cam position P of the second cam 62 changes. Specifically, from the time T13 to the time T14, the amount of cam displacement is gradually increased from the fourth cam position P4*b* in the second virtual circle a2 to a fifth cam position P5*b* in the third virtual circle a3.

The second cam 62 is maintained at the fifth cam position P5*b* from the time T14 to a time T15. By setting the time T14 to be longer than the time T5, a maintained time of the fifth cam position P5*b* of the second cam 62 is deviated with respect to a maintained time of the fifth cam position P5*a* of the first cam 61. That is, the maintained time of the fifth cam position P5*b* of the second cam 62 is delayed in time with respect to the maintained time of the fifth cam position P5*a* of the first cam 61.

From the time T15 to a time T16, the cam position P of the second cam 62 changes. Specifically, from the time T15 to the time T16, the amount of cam displacement is gradually reduced from the fifth cam position P5*b* in the third virtual circle a3 to the second cam position P2 in the first virtual circle a1.

The time T16 is set to be identical with the time T6. That is, an interval from the time T0 to the time T16 is set to be identical with an interval from the time T0 to the time T6.

The second cam 62 is maintained at the second cam position P2 from the time T16 to a time T17. By setting the time T17 to be identical with the time T7, the maintained time of the second cam position P2 is set to be identical with each other in both the first cam 61 and the second cam 62.

From the time T17 to a time T18, the cam position P of the second cam 62 changes. Specifically, from the time T17 to the time T18, the amount of cam displacement is gradually increased from the second cam position P2 in the first virtual circle a1 to the third cam position P3. By setting the time T18 to be identical with the time T8, the amounts of cam displacement are set to be identical with each other in both the first cam 61 and the second cam 62.

The second cam 62 is maintained at the third cam position P3 from the time T18 to a time T19. By setting the time T19 to be identical with the time T9, the maintained time of the third cam position P3 is set to be identical with each other in both the first cam 61 and the second cam 62.

From the time T19 to a time T20, the cam position P of the second cam 62 changes. Specifically, from the time T19 to the time T20, the amount of cam displacement is gradually increased from the third cam position P3 to the first cam position P1 in the fourth virtual circle a4. By setting the time T20 to be identical with the time T10, the amounts of cam displacement are set to be identical with each other in both the first cam 61 and the second cam 62.

The second cam 62 repeats the changes of the cam position P described above after the time T20. In other words, the time T20 is equivalent to the time T0.

Hereinafter, the operations of the first cam 61 and the second cam 62 from the first cam position P1 (reference position) to the second cam position P2 are described with respect to FIG. 7~FIG. 9.

Hereinafter, the actions of the first cam 61 are mainly described. As to the parts having same action as the first cam 61 in the second cam 62, the description thereof is not provided.

As shown in FIG. 7 and FIG. 9, the protruding section 61*b* is positioned between the first cam position P1 and the second cam position P2 in the rotation direction v of the first cam 61. By arranging the protruding section 61*b* at such a position, the following action is provided. When the first cam 61 moves from the first cam position P1 to the second cam position P2 in the rotation direction v of the first cam 61, the protruding section 61*b* moves the press roller 51 close to the heat roller 50 temporarily during a period of time the press roller 51 is separating from the heat roller 50. When the first cam 61 moves from the first cam position P1 to the second cam position P2 in the rotation direction v of the first cam 61, the press roller 51 moves close to the heat roller 50 temporarily. Compared to a case in which the protruding section 61*b* is not arranged, a speed of separating the press roller 51 from the heat roller 50 (hereinafter referred to as a "separation speed") decelerates between the first cam position P1 and the second cam position P2. By decelerating the separation speed of the press roller 51, the load fluctuation at the switch time is reduced.

When viewed from the direction along the rotation axis Cp, the protruding section 61*b* is curved such that a convex is formed at the outer peripheral side of the first cam 61. By arranging the protruding section 61*b* in such a manner, the separation speed of the press roller 51 decelerates gradually. Consequently, the load fluctuation at the switch time is reduced gradually.

Hereinafter, the actions of the second cam 62 different from those of the first cam 61 are described.

As shown in FIG. 8 and FIG. 9, when viewed from the direction along the rotation axis Cp, the protruding section 62*b* of the second cam 62 is slightly deviated to the upstream side of the protruding section 61*b* of the first cam 61 in the rotation direction v. By making the protruding section 62*b* of the second cam 62 deviate from the protruding section 61*b* of the first cam 61 in the rotation direction v, deceleration timings of the first cam 61 and the second cam 62 are deviated from each other. As a result, the load fluctuation at the switch time is distributed. Further, when viewed from the direction along the rotation axis Cp, the protruding section 62*b* of the second cam 62 may be slightly deviated to the downstream side of the protruding section 61*b* of the first cam 61 in the rotation direction v.

Hereinafter, a control system 110 which controls the switching mechanism 60 is described.

Figure 11:
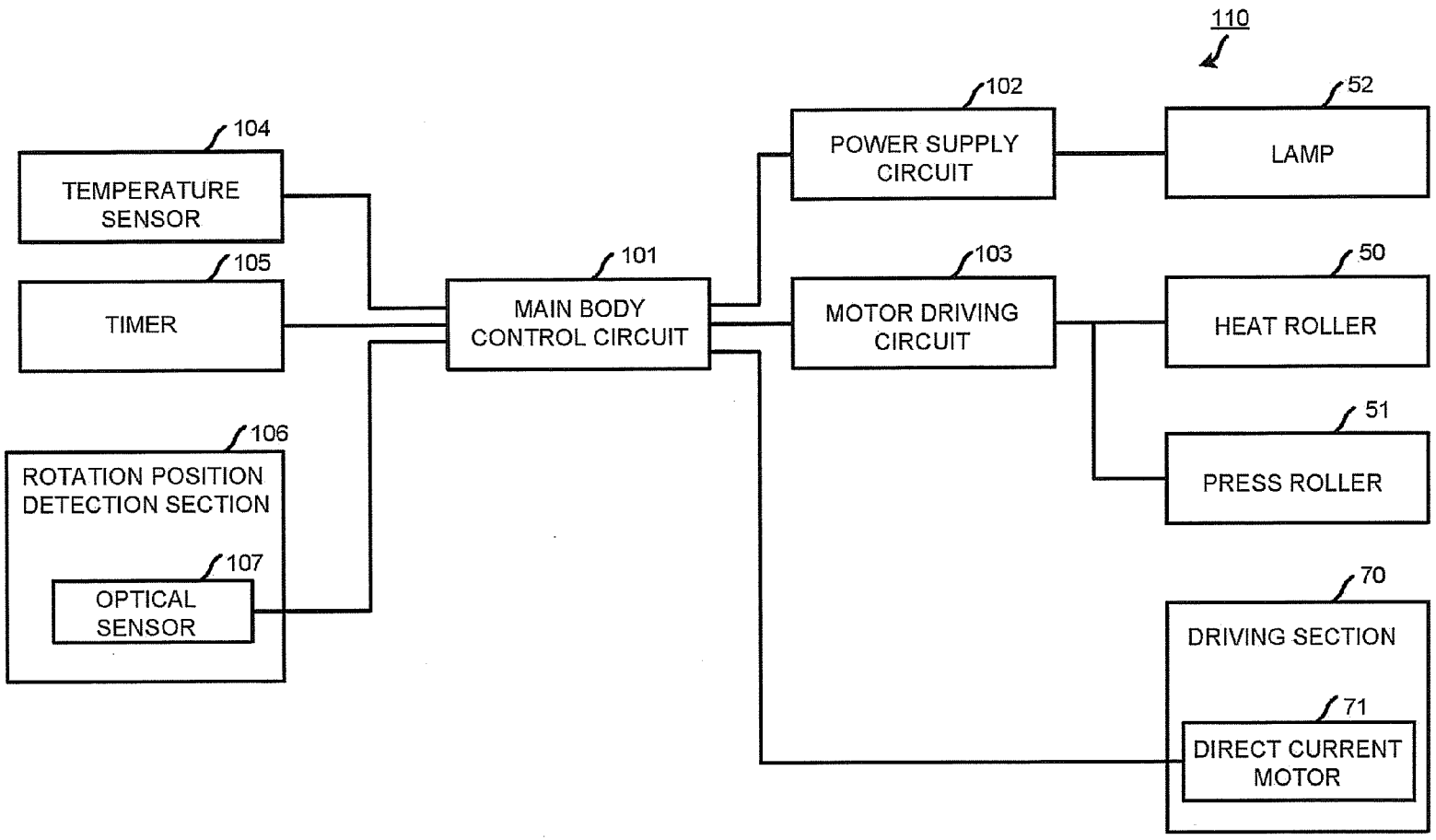
FIG. 11 is a block diagram illustrating a control system mainly controlling a switching mechanism according to the embodiment.

FIG. 11 is a block diagram illustrating the control system 110 mainly controlling the switching mechanism 60 according to the embodiment.

As shown in FIG. 11, the control system 110 comprises a main body control circuit 101. In the main body control circuit 101, a temperature sensor 104, a timer 105, a power supply circuit 102, a motor driving circuit 103, the DC motor 71 and the optical sensor 107 are electrically connected.

The temperature sensor 104 detects the temperature of the heat roller 50. The timer 105 manages the time. The power supply circuit 102 supplies power to the lamp 52. The motor driving circuit 103 rotates the heat roller 50 and the press roller 51 in a conveyance direction of the sheet P. By enabling the DC motor 71 to rotate in one direction, the first cam 61 and the second cam 62 can also be set to rotate in one direction (the direction indicated by the arrow v). Further, by enabling the DC motor 71 to rotate in both the forward direction and the reverse direction, the first cam 61 and the second cam 62 may also be set to rotate in both the forward direction and the reverse direction. The optical sensor 107 detects the rotation positions of the first cam 61 and the second cam 62.

The main body control circuit 101 controls ON/OFF of power supply to the power supply circuit 102 based on the detection result of the temperature sensor 104. In this way, the heat generation of the lamp 52 is controlled. As a result, the heat generation of the heat roller 50 is controlled. Thus, the fixing temperature is maintained.

The main body control circuit 101 switches the positions of the press roller 51 by rotating the DC motor 71. For example, at the non-sheet-passing time, the main body control circuit 101 sets the press roller 51 at the separation position, which prevents the heat roller 50 and the press roller 51 from roller creep.

On the other hand, at the sheet-passing time, the main body control circuit 101 sets the press roller 51 to be at the contact position. For example, the main body control circuit 101 switches the positions of the press roller 51 based on the information of the sheet P. For example, in a case of setting the normal paper as the information of the sheet P, the press roller 51 is set to be at the contact position. For example, in a case of setting the thick paper as the information of the sheet P, the press roller 51 is set to be at the semi-contact position.

The main body control circuit 101 stops at each position of the positions of the press roller 51 switched by the switching mechanism 60 based on the detection result of the optical sensor 107.

Incidentally, there is a possibility that a motion sound generates due to the load fluctuation at the switch time. Especially, the pressing force of the press roller 51 is set to be large in the high-speed color copier to guarantee the fixing property. The press roller 51 presses the heat roller 50 to form the nip 54. To guarantee the fixing property, it is necessary to guarantee that the nip 54 is wide. To guarantee that the nip 54 is wide, it is considered to increase an amount of engagement. Further, reducing the heat capacity of the heat roller 50 is effective to shorten a warming-up time and a first print time. It is required to separate the press roller 51 from the heat roller 50 absolutely at a non-sheet-passing time to reduce the heat capacity of the heat roller 50. However, if the amount of engagement is increased at the sheet-passing time, the movement distance of the press roller 51 from the contact position to the separation position becomes long. At this time, to realize miniaturization and low cost, enough space for the switching mechanism can hardly be guaranteed in the high-speed color copier. Thus, in the high-speed color copier, the load fluctuation at the switch time tends to become large, and therefore there is a possibility that the motion sound becomes louder.

In accordance with the present embodiment, the first cam 61 includes the first position regulating section S11, the second position regulating section S12, and the position changing section S15. The first position regulating section S11 sets the contact position. The second position regulating section S12 sets the separation position. The position changing section S15 is positioned between the first position regulating section S11 and the second position regulating section S12 in the rotation direction v of the first cam 61. The position changing section S15 includes the fluctuation section for setting the fluctuation position. The position changing section S15 includes the protruding section 61*b* as the first fluctuation section (fluctuation section). The protruding section 61*b* moves the press roller 51 close to the heat roller 50 temporarily during a period of time the press roller 51 is separating from the heat roller 50. The protruding section 61*b* is positioned between the first position regulating section S11 and the second position regulating section S12 in the rotation direction v of the first cam 61, in this way, the following action is provided. When the first cam 61 moves from the first cam position P1 to the second cam position P2 in the rotation direction v of the first cam 61, the protruding section 61*b* moves the press roller 51 close to the heat roller 50 temporarily during a period of time the press roller 51 is separating from the heat roller 50. When the first cam 61 moves from the first cam position P1 to the second cam position P2 in the rotation direction v of the first cam 61, the press roller 51 moves close to the heat roller 50 temporarily. Compared to a case in which the protruding section 61*b* is not arranged, the separation speed of the press roller 51 decelerates between the first cam position P1 and the second cam position P2. By decelerating the separation speed of the press roller 51, the load fluctuation at the switch time is reduced. Thus, it is possible to lower the motion sound at the switch time.

The first cam 61 and the second cam 62 different from the first cam 61 are arranged as the cam. A first fluctuation section arranged in the first cam 61 and a second fluctuation section arranged in the second cam 62 are arranged as the fluctuation section. The first cam 61 is provided with the protruding section 61*b* as the first fluctuation section. The second cam 62 is provided with the protruding section 62*b* as the second fluctuation section. The first cam 61 switches the position at a first end of the press roller 51. The second cam 62 switches the position at a second end of the press roller 51. By arranging the first cam 61 and the second cam 62, the deceleration timings at the two ends of the press roller 51 can be deviated from each other. As a result, the load fluctuation at the switch time can be distributed. Thus, the motion sound at the switch time can be effectively lowered when compared with a case in which cams having same fluctuation sections are arranged.

The first cam 61 and the second cam 62 rotate integrally together with the cam shaft 73. The protruding section 61*b* (first fluctuation section) and the protruding section 62*b* (second fluctuation section) differs from each other in phases. For example, by making the protruding section 62*b* of the second cam 62 deviate from the protruding section 61*b* of the first cam 61 in the rotation direction v, the deceleration timings of the first cam 61 and the second cam 62 are deviated from each other. As a result, the load fluctuation at the switch time can be distributed. Thus, the motion sound at the switch time can be effectively lowered when compared with a case in which cams having same phases are arranged.

When viewed from the direction along the rotation axis Cp, the protruding section 61*b* is curved such that a convex is formed at the outer peripheral side of the first cam 61. By arranging the protruding section 61*b* in such a manner, the separation speed of the press roller 51 can decelerate gradually. Consequently, the load fluctuation at the switch time can be reduced gradually. Thus, the motion sound at the switch time can be effectively lowered.

When viewed from the direction along the rotation axis Cp, the second position regulating section S12 is curved such that a convex is formed at the inner peripheral side of the first cam 61. The separation position is easier to be maintained when compared with a case in which the second position regulating section S12 is curved such that a convex is formed at the outer peripheral side of the first cam 61.

The DC motor 71 is provided as a motor for driving the first cam 61. The DC motor 71 has no function of controlling the motor speed. For example, the DC motor 71 is set to a brush motor. When compared with a case of comprising a stepping motor as the motor for driving the first cam 61, simplicity and low cost can be realized while motion sound at the switch time occurs easily in a case of comprising the brush motor. Thus, by comprising the DC motor 71, simplicity and low cost can be realized and the practical benefit in lowering the motion sound at the switch time is large.

The cam main body 61*a* and the protruding section 61*b* are formed integrally with the same material. When compared with a case in which the cam main body 61*a* and the protruding section 61*b* are formed separately from each other with different materials, the simplicity and low cost of the first cam 61 can be realized.

The first cam 61 further comprises the third position regulating section S13 for setting the semi-contact position. Thus, the motion sound at the switch time can be lowered in the constitution having the separation position, the contact position and the semi-contact position as the positions of the press roller 51.

Hereinafter, modifications are described.

For example, a fixing belt may be arranged as the fixing member. The fixing belt has a conductive layer. By heating the conductive layer of the fixing belt through an electromagnetic induction heating system (hereinafter referred to as an "IH system"), the conductive layer generates heat through induction current. Thus, the motion sound at the switch time can be lowered in the IH system.

The cam is not limited to the plate cam. For example, the cam may be a translating cam, a plane groove cam, a conjugate cam, an end face cam, a cylindrical cam, a spherical cam, and the like. The switching mechanism may be changed according to the design specification.

The driving of the cam is not limited to rotating the cam. For example, in a case in which the cam is a translating cam, the driving of the cam may be straight advancing driving. The driving of the cam may be changed according to the shape of the cam and the like.

Cams having same fluctuation sections with each other may be arranged as the cams. When compared with a case of comprising cams having fluctuation sections different from each other, the simplicity and low cost can be realized.

The first cam 61 and the second cam 62 may rotate separately from the cam shaft 73. The first cam 61 and the second cam 62 may be driven independently from each other. For example, the first cam 61 may switch the position at the first end of the press roller 51 separately from the switching by the second cam 62. The second cam 62 may switch the position at the second end of the press roller 51 separately from the switching by the first cam 61.

When viewed from the direction along the rotation axis Cp, the fluctuation section is not limited to include a protruding section which protrudes towards the outer peripheral side of the cam. For example, when viewed from the direction along the rotation axis Cp, a recess part (recess) recessed towards the inner peripheral side of the cam may be formed as the fluctuation section.

The holding section 80 may not comprise the first arm 81 and the second arm 82. For example, the holding section may comprise one arm but not a plurality of arms. The holding section may support the press roller 51 and the cam follower 83 in a rotatable manner through the one arm.

It is not limited to arrange a brush motor as the motor for driving the first cam 61. For example, a stepping motor may be arranged as the motor for driving the first cam 61.

The cam main body 61*a* and the protruding section 61*b* are not limited to be formed integrally with same material. For example, the cam main body 61*a* and the protruding section 61*b* may be formed separately from each other with different material.

The first cam 61 may not comprise the third position regulating section S13 for setting the semi-contact position. In a case of not comprising the third position regulating section S13, the motion sound at the switch time can be lowered in the constitution having the separation position and the contact position as the positions of the press roller 51.

Further, it is not limited to that the press roller 51 (the first roller) moves towards the heat roller 50 (the second roller). For example, the heat roller 50 (the second roller) may move towards the press roller 51 (the first roller). In a case in which the heat roller 50 moves towards the press roller 51, the press roller 51 doesn't move towards the heat roller 50. That is, the position of the press roller 51 is set to a fixed position.

In accordance with at least one embodiment described above, the first cam 61 includes the first position regulating section S11, the second position regulating section S12, and the position changing section S15. The first position regulating section S11 sets the contact position. The second position regulating section S12 sets the separation position. The position changing section S15 is positioned between the first position regulating section S11 and the second position regulating section S12 in the rotation direction v of the first cam 61. The position changing section S15 includes the fluctuation section for setting the fluctuation position. The position changing section S15 includes the protruding section 61*b* as the first fluctuation section (fluctuation section). The protruding section 61*b* moves the press roller 51 close to the heat roller 50 temporarily during a period of time the press roller 51 is separating from the heat roller 50. The protruding section 61*b* is positioned between the first position regulating section S11 and the second position regulating section S12 in the rotation direction v of the first cam 61, in this way, the following action is provided. When the first cam 61 moves from the first cam position P1 to the second cam position P2 in the rotation direction v of the first cam 61, the protruding section 61*b* moves the press roller 51 close to the heat roller 50 temporarily during a period of time the press roller 51 is separating from the heat roller 50. When the first cam 61 moves from the first cam position P1 to the second cam position P2 in the rotation direction v of the first cam 61, the press roller 51 moves close to the heat roller 50 temporarily. Compared to a case in which the protruding section 61*b* is not arranged, the separation speed of the press roller 51 decelerates between the first cam position P1 and the second cam position P2. By decelerating the separation speed of the press roller 51, the load fluctuation at the switch time is reduced. Thus, it is possible to lower the motion sound at the switch time.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form an image on an image receiving medium;

a fixing section configured to include a first roller, a second roller facing the first roller and a switching mechanism provided with a cam for switching positions of the first roller; and a control section configured to control a driving of the cam, wherein the positions of the first roller switched by the switching mechanism include a contact position where the first roller contacts with the second roller and a separation position where the first roller separates from the second roller, the cam includes a first position regulating section setting the contact position, a second position regulating section setting the separation position and a position changing section which is positioned between the first position regulating section and the second position regulating section in a driving direction of the cam, and the position changing section includes a fluctuation section for moving the first roller close to the second roller temporarily during a period of time the first roller is separating from the second roller.

2. The image forming apparatus according to claim 1, wherein a first cam and a second cam different from the first cam are arranged as the cam, a first fluctuation section arranged in the first cam and a second fluctuation section arranged in the second cam are arranged as the fluctuation section, the first cam switches positions at a first end of the first roller, and the second cam switches positions at a second end of the first roller.

3. The image forming apparatus according to claim 2, further comprising:

a cam shaft configured to be extended in a direction parallel to a width direction the second roller, wherein the first cam is fixed at a first end of the cam shaft, the second cam is fixed at a second end of the cam shaft, the first cam and the second cam rotate integrally together with the cam shaft, the first fluctuation section and the second fluctuation section differs from each other in phases.

4. The image forming apparatus according to claim 1, wherein the fluctuation section includes a protruding section protruding to an outer peripheral side of the cam when viewed from a direction along a rotation axis of the cam.

5. The image forming apparatus according to claim 4, wherein the cam includes a cam main body and the protruding section, and the cam main body and the protruding section are formed integrally with a same material.

6. The image forming apparatus according to claim 1, wherein the second position regulating section bends so as to form a convex at the inner peripheral side of the cam when viewed from the direction along the rotation axis of the cam.

7. The image forming apparatus according to claim 1, wherein a direct current motor is arranged as a motor for driving the cam.

8. The image forming apparatus according to claim 1, further comprising:

a cam follower configured to be contacted with the cam;

a first arm configured to support the cam follower in a rotatable manner; and a second arm configured to be supported by the first arm in a swingable manner and to support the first roller in a rotatable manner.

9. The image forming apparatus according to claim 8, further comprising:

an elastic member configured to energize in a direction in which the first roller is pressed to the second roller, wherein the elastic member is compressed in response to an amount of swing displacement of the first arm with respect to the second arm when the first roller presses to the second roller.

10. The image forming apparatus according to claim 1, wherein the positions of the first roller switched by the switching mechanism further includes a semi-contact position where the first roller contacts with the second roller under a pressing force smaller than the pressing force at the contact position, and the cam further includes a third position regulating section configured to set the semi-contact position.

* * * * *